United States Patent [19]

Berkman

[11] 4,219,063

[45] Aug. 26, 1980

[54] TOOL FOR HOLDING A FASTENER TO A DRIVER THEREFOR

[75] Inventor: Samuel Berkman, Florham Park, N.J.

[73] Assignee: BST & Associates, Inc., Florham Park, N.J.

[21] Appl. No.: 58,765

[22] Filed: Jul. 19, 1979

Related U.S. Application Data

[63] Continuation-in-part of Ser. No. 809,163, Jun. 23, 1977, abandoned.

[51] Int. Cl.[3] ..... B25B 15/00

[52] U.S. Cl. ..... 145/52; 145/50 DA

[58] Field of Search ..... 145/50 DA, 50 D, 52, 145/30 A, 30 R

[56] References Cited

U.S. PATENT DOCUMENTS

| | | | |
|---|---|---|---|
| 2,491,860 | 12/1949 | Ingraham | 145/46 |
| 2,688,991 | 9/1954 | Doyle | 145/52 |
| 2,960,131 | 11/1960 | Clark | 145/52 |
| 3,731,722 | 5/1973 | Carr | 145/50 DA |

FOREIGN PATENT DOCUMENTS

| | | | |
|---|---|---|---|
| 635672 | 3/1962 | Italy | 145/52 |

*Primary Examiner*—Othell M. Simpson
*Assistant Examiner*—J. T. Zatarga

[57] ABSTRACT

An auxiliary tool for holding a rotatable fastener in engaged relation with a driving tool until the fastener can be started into the work is versatile and can be used with many different kinds of driving tools. In use, the present tool is secured magnetically to a ferrous metal portion of the driving tool. Spring rods on the tool can be separated and engaged with a fastener to hold the fastener therebetween and in engagement with the driving portion of the driving tool. Once the fastener is well started into the work, the present tool can be quickly and easily removed to permit the driving tool to be used alone.

8 Claims, 10 Drawing Figures

TOOL FOR HOLDING A FASTENER TO A DRIVER THEREFOR

This application is a Continuation-in-Part of application Ser. No. 809,163, filed June 23, 1977, and now abandoned.

In the use of rotatable fasteners such as various kinds of screws, nuts, bolts, and the like, it often occurs that it is difficult or impossible for the artisan to hold the fastener manually while starting the fastener into the work. The present device is adapted to hold such a fastener in engaged relation with the driver therefor so as to relieve the artisan from any such requirement of holding the fastener manually, especially in a difficult location, to thus enable one-handed operation.

Certain tools are available, screwdrivers, for example, which are provided with integral fastener holding means. One common form of screwdriver for example has a sleeve around the shank thereof from which project several spring arms for engaging a fastener. The sleeve can be advanced so that the spring arms are separated and a screw or other fastener can then be placed into engagement with the screwdriver and the sleeve retracted so as to allow the spring arms to grasp the fastener and hold it in place on the screwdriver. The artisan then can advance the screwdriver toward the work and begin to engage the fastener with the work without holding the fastener manually. While such screwdrivers are quite effective, it also happens that the requirement for one handed operation exists with other tools. Moreover, unless the artisan is provided with a full compliment of specifically adapted tools, he is at the mercy of the situation. For example most of the screwdrivers which are provided with fastener holding means are of the flat bladed variety. Philips screwdrivers, nutdrivers, and the like are seldom provided with this form of holding means.

Fastener holding tools designed as separate items for attachment to screwdrivers are known. While these devices may be effective, they do not appear to have been marketed. These attachments are generally applied to the driving tool by sliding them over the free end thereof and do not appear to be readily removable from the tool once their function of holding the fastener in the initial starting thereof is complete, unless the tool is disengaged from the fastener being driven.

The present device is a tool which can be used by the artisan in association with a wide variety of driving tools. The device employs a magnetic means to secure itself to the driving tool, most of which are provided with ferrous metal portions of right circular cylinder character to which the magnetic means can be readily applied. Secured to the magnetic means are a pair of spring steel arms which can be separated and engaged with a fastener in order to hold that fastener in engagement with the driving tool. If a particular job requires the use of different kinds of driving tools, the present novel device can be quickly and readily transferred from one to another.

Figure 1:
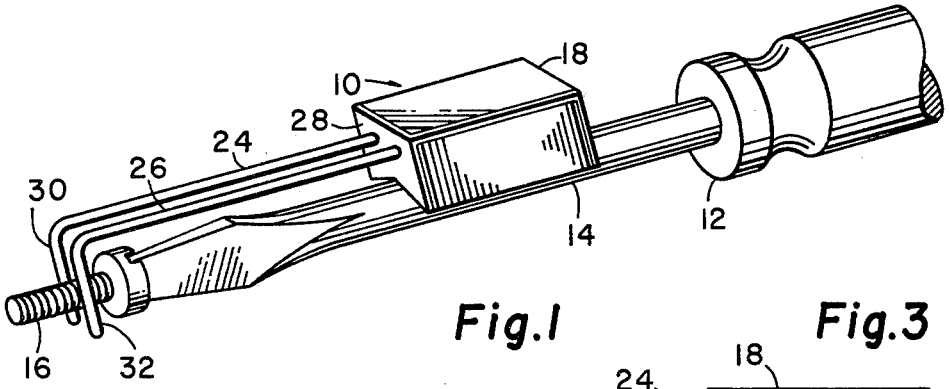
FIG. 1 is a perspective view of a flat bladed screwdriver and a fastener to be driven with one form of the present novel device in place on the shank of the screwdriver and holding the fastener in place.
Figure 3:
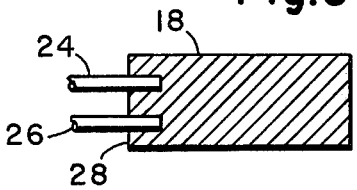
FIG. 3 is a partial sectional view taken along the line 3—3 of FIG. 2.
Figure 2:
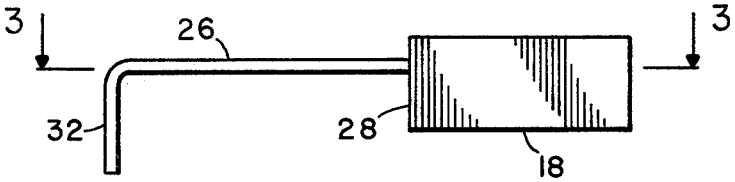
FIG. 2 is a side view of the embodiment of the present device shown in FIG. 1.
Figure 4:
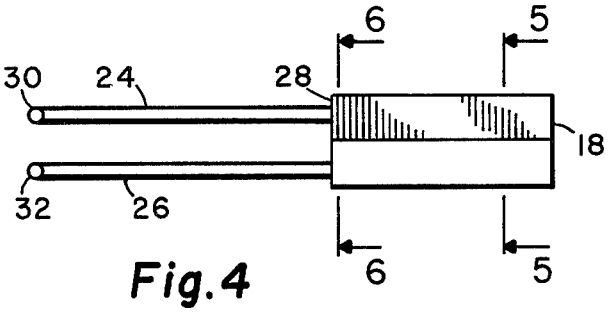
FIG. 4 is a top view of the embodiment shown in FIG. 2.

In one of its embodiments, the present novel fastener holding attachment is indicated at 10 in FIG. 1. As there shown, the attachment 10 is in engaged relation with a flat-bladed screwdriver 12, particularly with the cylindrical shaft 14 thereof. In the relationship shown, the attachment 10 is holding a wood screw 16 in engagement with the screwdriver 12.

Figure 5:
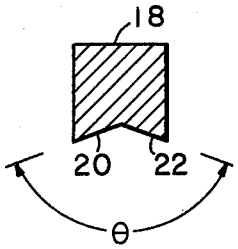
FIG. 5 is a section taken on the line 5—5 of FIG. 4.
Figure 6:
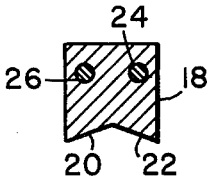
FIG. 6 is a section taken along the line 6—6 of FIG. 4.

In the present embodiment, the attachment 10 comprises a magnetic block 18. The block 18 is provided on one of its sides with surfaces 20 and 22 which are angularly related to each other, and to the remaining sides of the block 18, so as to form what is generally known as a V-groove or notch (see FIGS. 5 and 6). The angular relation of the surfaces 20 and 22 to each other establishes a dihedral angle which is selected to be of such a magnitude that the block can be used with shafts of a variety of sizes and shapes, particularly those sizes and shapes which are commonly found in hand-type driving tools.

Ordinarily, the block 18 may be, as one example, approximately 1.5 inches (about 3.8 cm.) long, 0.5 inch (about 1.3 cm.) on its short sides, and the dihedral angle may have a value between 90° and 170°. The specific dimensions of the block 18 are not critical to the present invention and it is to be contemplated that blocks of various sizes with various dihedral angles may be employed. As another example, a block 18 having a length of one inch (about 2.5 cm.), short sides of about ⅛ inch (about 1 cm.) and a similar range of dihedral angles has been employed.

In the embodiment shown in FIGS. 1 to 6, the attachment 10 has a pair of cylindrical spring steel rods 24 and 26 extending from one of the end surfaces 28 of the block 18. Any means of attaching the rods 24 and 26 to the block 18 may be employed. In the present example, the rods 24 and 26 are embedded in the block 18, as by inserting them in press fit relation in apertures or blind holes in the block 18.

Each of the rods 24 and 26 is L-shaped. The long portion of each of the rods 24 and 26 extends out from the block 18 in a direction such that these portions of the rods 24 and 26 will lie substantially parallel to the longitudinal axis of the shaft 14 of the screwdriver 12 in this example. The relatively short portions, 30 and 32, of the rods 24 and 26, respectively, lie substantially at a right angle to the longer portions thereof and thus extend in direction substantially normal to the longitudinal axis of the tool. Note that this axis is also the axis of rotation of the fastener which is to be driven by the tool.

The length of the portions 30 and 32 of the rods 24 and 26, respectively, should be chosen such that these portions extend beyond the axis of the shaft 14 when regarded from the side to which the block 18 is fastened.

In the usual manner of using the attachment 10, the rods 24 and 26 are manually spread so that the portions 30 and 32 thereof can span the shank of the fastener to be driven, after which they are released into holding engagement with the fastener. The block 18 is then engaged with the shank of the driving tool and moved along the shank until the fastener engages the driving tool, in the relationship shown in FIG. 1. The fastener is then engaged with, and started into, the work. Once the fastener is well started, the attachment 10 may be quickly and easily removed so that the driving can be completed.

Figure 7:
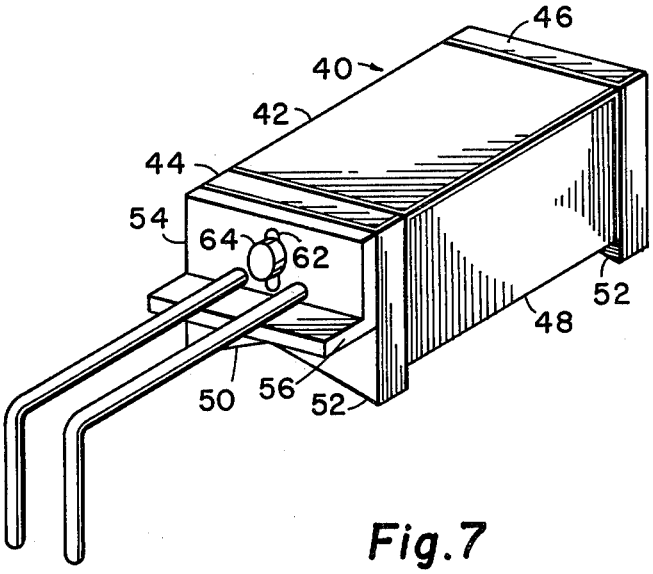
FIG. 7 is a perspective view of another embodiment of the present novel device.

FIG. 7 illustrates another embodiment of the present novel tool attachment, designated here by the reference numeral 40. In this embodiment, there is a magnetic block, in this case a rectangular prismatic block 42, although any shape, including cylindrical, is acceptable. To the respective opposite ends of the block 42 are attached a pair of magnetic force concentrating pole pieces 44 and 46 which are dimensioned to extend beyond the lower face 48 of the magnetic block 42, as shown. In the extensions of the pole pieces 44 and 46, surfaces 50 and 52, having a V-groove configuration, are provided. These surfaces 50 and 52 act similarly to the surfaces 20 and 22 of the attachment 10 in the previous embodiment.

On the near face of the pole piece 44, as shown in FIG. 7, an L-shaped bracket element 54, preferably of non-magnetic material, is attached. The bracket element 54 has a ledge 56 to which are attached, as by welding, brazing, or other means, a pair of spring rods 58 and 60 like the rods 24 and 26 of the previous embodiment.

In the attachment 40, the rods 58 and 60 are adjustable relative to the magnetic block 42 in a slidable and rotatable fashion. For this purpose, the bracket 54 is provided with a slot 62 through which a headed pin fastener 64 may pass into engagement with the pole piece 44. The bracket 54 may thus be rotated about the pin 64 or may slide along the length of the slot 62 to adjust the position of the rods 58 and 60 to suit various applications. Although not shown, the fastener 64 may have a spring washer or the like beneath the head thereof and in engagement with the bracket 54 so that the adjusted position thereof may be retained frictionally.

Figure 8:
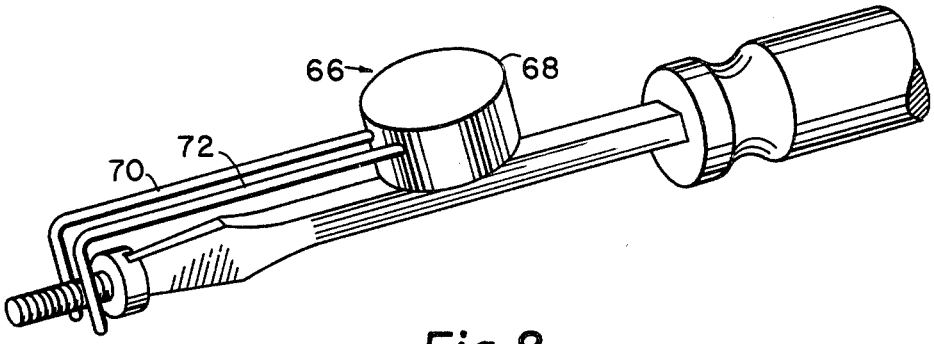
FIG. 8 is a perspective view of still another embodiment of the present novel device, shown in place on a square shanked screwdriver.

As suggested in FIG. 8, the V-groove feature of the present attachment is not required in all instances, although it is preferred. The device shown in FIG. 8, indicated generally by the numeral 66, is shown in engagement with a screwdriver having a square shank. In this case, the magnetic block element may be a simple disc magnet 68 from which L-shaped rods 70 and 72 extend.

Figure 9:
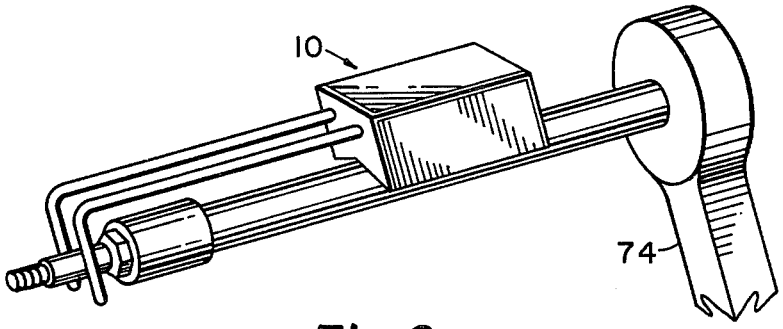
FIG. 9 is a perspective view of a ratchet-type socket wrench with a generally-shown form of the present novel device holding a fastener in engagement therewith.

The present device is not limited in application to screwdrivers, but may be used with any rotatable fastener driving tool. FIG. 9 shows how a device like the device 10 may be used with, for example, a ratchet-type socket driver 74 of conventional form.

Figure 10:
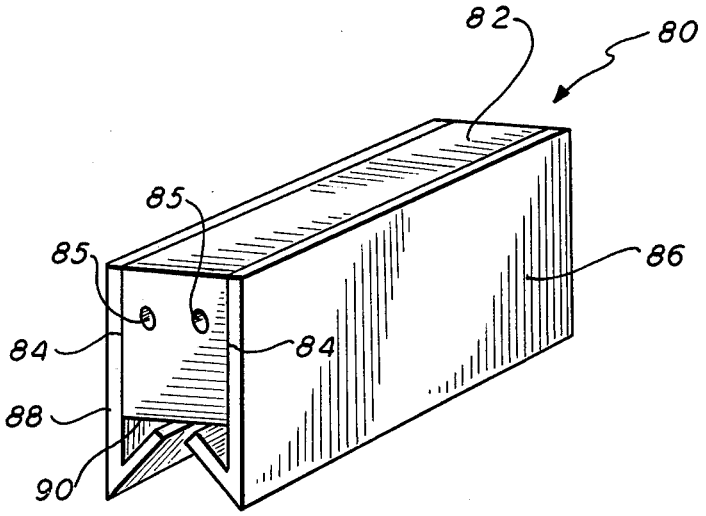
FIG. 10 is a perspective view of an alternative embodiment of a magnetic block assembly useful in the present novel device.

The present device is also not limited to a magnetic block with its magnetic axis oriented parallel to the driving tool axis as in the previous embodiments. FIG. 10 shows an alternative magnetic block assembly 80 which can be used in the device. The assembly 80 has a magnet 82 with side surfaces 84, and the magnet 82 is magnetized laterally, i.e. with its North and South poles adjacent to the respective side surfaces 84. Openings 85 are provided in the magnet 82 for receiving spring arms like the arms 24 and 26 of the device 10.

Pole pieces 86 and 88 are attached to the side surfaces (or magnetic "end" surfaces) 84 of the magnet 82 and are dimensioned to extend beyond the lower surface, 90, of the magnet 82. Each of the pole pieces 86 and 88 has an inturned flange, 92 and 94, respectively, which extend at acute angles totthe general planes of the pole pieces 86 and 88 to define a V-shaped surface for contact with the cylindrical tool shafts. Flux is coupled into the shaft laterally in this embodiment. Improved holding power, relative to the device 40 of FIG. 7, is available because the holding power is proportional to the area of contact between the assembly 80 and a tool shaft, and this pole piece arrangement provides more contact area. Relative to the block 18 of the device 10, which may also be magnetized laterally if desired, the available holding force is slightly improved by the concentrating effect of the pole pieces 86 and 88.

It should thus be apparent that a tool has been provided which may be attached and removed from the driver with ease, owing to the magnetic attachment feature thereof. The present novel tool is especially adapted for use in tight or blind areas where it is difficult if not impossible for the artisan to hold the fastener in place manually at the initiation of the driving operation. Once the fastener has been started into the work, the present attachment can be quickly removed so that the driving of the fastener can proceed unimpeded. Because only a single magnetic block, which does not surround the shaft of a driving tool, is used, removal from the side of the driving tool without disengaging the driving tool from the fastener is possible.

What is claimed is:

1. A tool adapted to hold a rotatable fastener in engaged relation with a driver for said fastener comprising a single magnetic block adapted to be attached via magnetic force to a ferrous portion of said driver, and adapted to be removed laterally from said driver without disengaging the driver from the fastener, and a pair of resilient rods extending from said magnetic block, said rods each having a first portion adapted to extend in a direction generally parallel to the axis of rotation of said fastener and a second portion adapted to extend in a direction generally transverse to said axis of rotation.

2. A tool as defined in claim 1 adapted for cooperation with a driver having a circularly cylindrical ferrous portion wherein said magnetic block has a V-grooved side, said V-grooved side being characterized by a dihedral angle large enough so that said ferrous portion contacts each of the surfaces of said V-grooved side along lines located intermediate said surfaces.

3. A tool as defined in claim 1 further comprising a pair of pole pieces, one attached to each end of said magnetic block.

4. A tool as defined in claim 1 further comprising a pair of pole pieces, one attached to each end of said magnetic block, each pole piece extending beyond said magnetic block and having a V-groove side adapted for engagement with said driver.

5. A tool as defined in claim 4 further comprising an L-shaped bracket attached to one of said pole pieces, said resilient rods being attached to said bracket.

6. A tool as defined in claim 5 wherein said bracket is slidably and rotatably attached to said pole piece.

7. A tool as defined in claim 1 wherein said magnetic block has side surfaces and said tool further comprises pole pieces, one attached to each of said side surfaces and each pole piece extending beyond said magnetic block and adapted to contact said driver along lines parallel to the axis thereof.

8. A tool as defined in claim 7 in which each pole piece has an inturned flange extending at an acute angle to the general plane thereof.

* * * * *